US005769614A

United States Patent [19]

Karasawa

[11] Patent Number: 5,769,614

[45] Date of Patent: Jun. 23, 1998

[54] HIGH PRESSURE PUMP

[76] Inventor: Yukihiko Karasawa, 3-27, Oaza-Minami-Nakano, Ohmiya-shi, Saitama 330, Japan

[21] Appl. No.: 841,268

[22] Filed: Apr. 29, 1997

Related U.S. Application Data

[63] Continuation of Ser. No. 268,160, Jun. 29, 1994, abandoned.

[30] Foreign Application Priority Data

Jun. 29, 1993 [JP] Japan ..... 5-158757

[51] Int. Cl.[6] ..... F04B 17/00

[52] U.S. Cl. ..... 417/403

[58] Field of Search ..... 417/401, 403

[56] References Cited

U.S. PATENT DOCUMENTS 3,174,409 3/1965 Hill ..... 417/403 X 4,477,232 10/1984 Mayer ..... 417/403 X 5,106,275 4/1992 Santi et al. ..... 417/403

5,173,036 12/1992 Fladby ..... 417/403

FOREIGN PATENT DOCUMENTS 357978 12/1961 Switzerland ..... 417/403

*Primary Examiner*—Richard E. Gluck

*Attorney, Agent, or Firm*—Kuhn and Muller

[57] ABSTRACT

A high-pressure pump having a high-pressure cylinder which has a vertically moving plunger fitted therein from the upper side thereof. The high-pressure cylinder has at least one opening in the bottommost portion thereof to allow a fluid to flow in or out of the high-pressure cylinder. A hydraulic cylinder for driving the plunger is provided on the top of the high-pressure cylinder. In addition, a migration preventing device is provided between the hydraulic cylinder and the high-pressure cylinder and in contact with the plunger driving shaft to prevent migration of a working fluid leaking out from the hydraulic cylinder to the surface of the plunger fitted in the high-pressure cylinder.

2 Claims, 2 Drawing Sheets

FIG. 2(a)
PRIOR ART
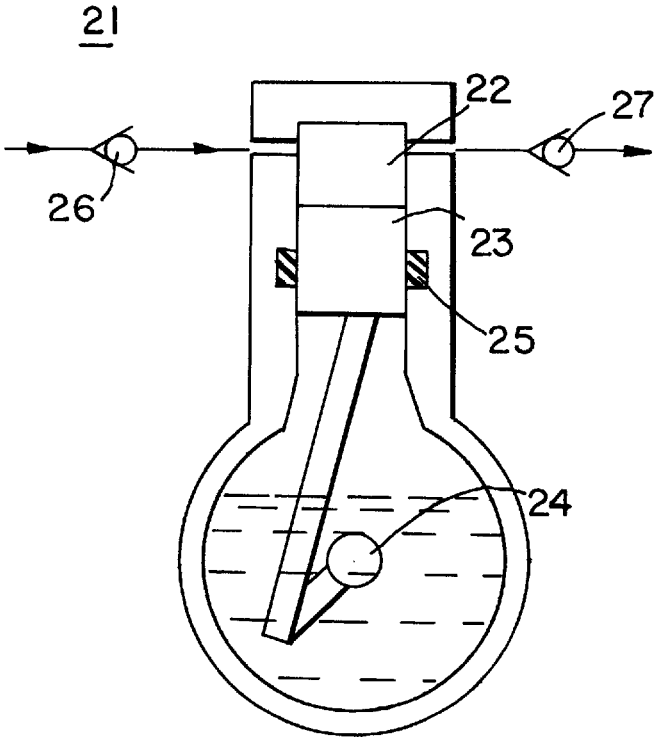
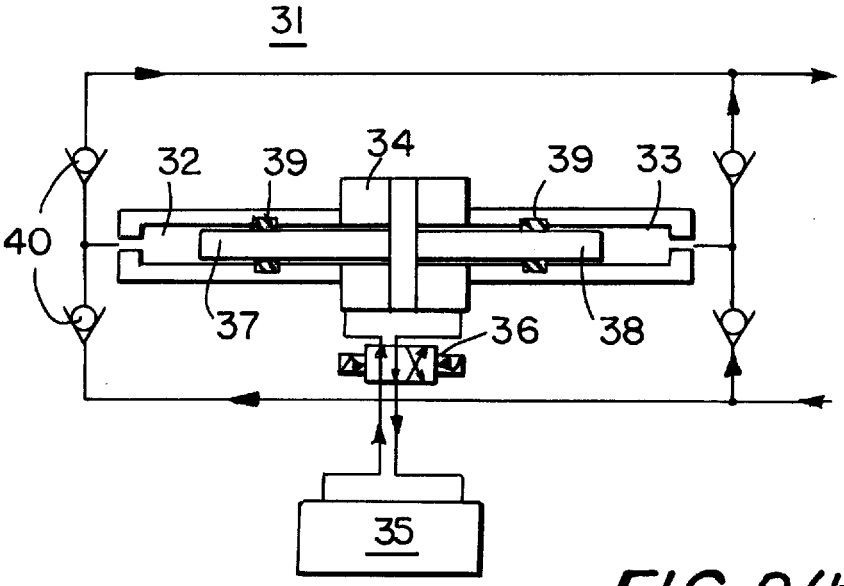
FIG. 2(b)
PRIOR ART

HIGH PRESSURE PUMP

This application is a continuation of application Ser. No. 08/268,160, filed Jun. 29, 1994, now abandoned.

BACKGROUND OF THE INVENTION

The present invention relates to a high-pressure pump for pressurizing a fluid to a high pressure. More particularly, the present invention relates to a high-pressure pump capable of continuously treating a solid-liquid mixed phase fluid under high pressure without a stop over a long period of time.

Various pumps are used to pressurize fluids to a high pressure. Known high-pressure pumps include a plunger pump, a diaphragm pump, etc. There are also known methods for driving such high-pressure pumps, in which the plunger or other pump constituent element is directly driven by a motor, or it is indirectly driven by hydraulic pressure.

Various types of high-pressure pumps are employed according to the kind of fluid used and the working pressure. In pumps for producing high-pressure water used for water jet processing of metals or substances of high hardness, a high pressure of 1,500 atm. or higher is used. In these pumps, an important part becomes worn to such an extent that the pumps cannot be used any longer after they have been used for about 500 to 2,000 hours. Therefore, the operation must be stopped to carry out replacement of parts.

In the meantime, emulsifiers for dispersing finely divided particles as a raw material in a liquid as another raw material to a high degree are widely used in the processes of manufacturing paints, pigments, ink, pharmaceuticals, organic and other photosensitive materials, magnetic recording mediums, etc. Although various emulsifiers are known, a sand grinder, a high-strength shearing dispersing machine, a colloid mill, an ultrasonic dispersing apparatus, etc. have heretofore been used to obtain an emulsion of high degree of dispersion. However, it has been difficult with such emulsifiers to obtain an emulsion of ultrafine particles or an emulsion containing a sufficiently small amount of aggregated fine particles.

Under these circumstances, various types of apparatuses have been proposed in which fluids which are to be emulsified are pressurized to a high pressure and allowed to collide with each other at high speed, thereby emulsifying them. For example, an emulsifier, in which two inlet passages and one outlet passage are formed by pipelines, and fluids are supplied from the two inlet passages at high speed so as to collide with each other, has been proposed. U.S. Pat. No. 4,533,254 proposes an apparatus wherein two members formed with groove-shaped flow paths are disposed with a spacing held therebetween by a shim to form an opening so that fluids introduced from the groove-shaped flow paths collide with each other at the opening, thereby obtaining an emulsion.

There has also been proposed an emulsifier wherein an inlet-side plate-shaped member provided with fluid inlet openings and an outlet-side plate-shaped member provided with a groove-shaped through hole are stacked with an intermediate plate-shaped member interposed therebetween which is formed with an intersection-shaped flow path, and fluids which are to be emulsified are supplied from the inlet openings of the inlet-side plate-shaped member, and after the direction of flow of the fluids has been changed at right angles, the fluids are allowed to collide with each other in a flow path formed between the grooves and the plate-shaped member, and then the fluids are allowed to flow from the intersection of the two grooves into a flow path defined by the groove formed in the plate-shaped member on the opposite side, thereby emulsifying the fluids.

The present applicant has also proposed an emulsifier of high durability as U.S. Pat. No. 5,380,009, in which a high-pressure vessel is provided therein with a thin plate-shaped member formed with a through-hole having a smaller diameter than that of a fluid flow path in the high-pressure vessel. From the center of the through-hole in the plate-shaped member, an outlet passage extends perpendicularly to the through-hole so as to communicate with a side of the plate-shaped member. Fluids are supplied from mutually opposing directions through the through-hole in the emulsifying part to collide with each other in the central portion of the plate-shaped member, thereby emulsifying the fluids.

These apparatuses make it possible to obtain a dispersion of excellent characteristics which cannot be obtained with the other conventional apparatuses. However, a high-pressure pump that is used therein for pressurizing a solid-liquid mixed phase fluid to a high pressure has a disadvantageously short service life. Therefore, the apparatuses need to frequently stop the operation of the high-pressure pump in order to replace parts worn by the solid-liquid mixed phase fluid. There is another problem that the concentration of solid in the solid-liquid mixed phase fluid discharged from the high-pressure pump cannot be kept constant.

FIGS. 2(*a*) and 2(*b*) show examples of conventional high-pressure pumps. FIG. 2(*a*) illustrates a high-pressure pump in which a plunger is directly driven by turning force of a motor. FIG. 2(*b*) illustrates a high-pressure pump in which a low-pressure portion is driven by hydraulic pressure.

In the high-pressure pump 21 shown in FIG. 2(a), a plunger 23 fitted in a pressurizing chamber 22 is driven by a crankshaft 24 which is coupled to a motor. A gasket 25 is provided in the pressurizing chamber 22 to prevent leakage of fluid from the plunger surface. The fluid is supplied through an inlet-side check valve 26, and the-pressurized fluid is discharged to an external circuit through an outlet-side check valve 27.

In the high-pressure pump 31 shown in FIG. 2(*b*), which is driven by hydraulic pressure, plungers 37 and 38 are installed with their axes lying horizontally, and high-pressure portions 32 and 33 are provided at the left- and right-hand sides, respectively. A single low-pressure portion 34 is provided in the center, and it is supplied through a switching valve 36 with a working fluid pressurized in a hydraulic pressure generator 35 to reciprocate the plungers 37 and 38 in the high-pressure portions 32 and 33, thereby sucking a fluid into the left and right high-pressure portions 32 and 33 and then pressurizing it. The high-pressure portions 32 and 33 are each provided with a gasket 39 for preventing leakage of fluid from the plunger surface. The external fluid circuit is provided with check valves 40 so that the high-pressure fluid is alternately supplied to the external circuit from the left and right high-pressure portions 32 and 33.

In the high-pressure pump shown in FIG. 2(*a*), when a solid-liquid mixed phase fluid having solid particles dispersed therein is introduced into the high-pressure cylinder and pressurized, solid particles settle by gravity. As a result, a region where the solid particle concentration is relatively high is present in the lower part of the high-pressure cylinder. Accordingly, the gasket that is in sliding contact with the plunger deteriorates early. Moreover, the concentration of the fluid discharged becomes nonuniform.

In the high-pressure pump shown in FIG. 2(*b*), since the low-pressure portion is driven by hydraulic pressure, it is possible to separate the portions which are pressurized by the working fluid and the high-pressure generating portions. Moreover, since the plungers are installed with their axes lying horizontally, two high-pressure portions can be provided at both sides of a single common low-pressure portion. Accordingly, an efficient high-pressure pump can be obtained, and the maintenance is also facilitated. In addition, even if the working fluid leaks out from the low-pressure portion, there is no possibility of the working fluid reaching either of the high-pressure portions.

However, when a solid-liquid mixed phase fluid having solid particles dispersed therein is pressurized in the high-pressure pump shown in FIG. 2(*b*), solid particles settle in the cylinders of the high-pressure portions to form a region where the solid particle concentration is relatively high in the lower part of each high-pressure cylinder. Accordingly, the gaskets that are in sliding contact with the plungers deteriorate early. Moreover, the concentration of the fluid discharged from each discharge portion cannot be kept constant.

Thus, the conventional high-pressure pumps used for pressurizing a solid-liquid mixed phase fluid suffer from great damage by wearing and hence necessitate replacing the gaskets early. From the industrial point of view, there has been almost no pump that is capable of continuously treating a solid-liquid mixed phase-fluid under high pressure. In general, the conventional high-pressure pumps can be continuously used for only about 100 hours at the utmost limit under the pressurizing condition of 100 kgf/cm$^2$.

An object of the present invention is to provide a high-pressure pump of superior durability, particularly a high-pressure pump of superior durability which is capable of pressurizing to a high level a fluid that may wear a constituent member of the pump, such as a solid-liquid mixed phase fluid.

SUMMARY OF THE INVENTION

The present invention provides a high-pressure pump for pressurizing a solid-liquid mixed phase fluid. The high-pressure pump has a high-pressure cylinder which has a vertically moving plunger fitted therein from the upper side thereof. The high-pressure cylinder further has at least one opening in the bottommost portion thereof to allow a fluid to flow in or out of the high-pressure cylinder. A hydraulic cylinder for driving the plunger is provided on the top of the high-pressure cylinder. The high-pressure pump further has a migration preventing device provided between the hydraulic cylinder and the high-pressure cylinder and in contact with the plunger driving shaft to prevent migration of a working fluid leaking out from the hydraulic cylinder to the surface of the plunger fitted in the high-pressure cylinder.

The high-pressure pump may have a plurality of hydraulic cylinders and high-pressure cylinders, which are arranged as described above. In this case, the working fluid is supplied to the hydraulic cylinders through a switching valve to produce a high-pressure fluid from the high-pressure cylinders alternately.

The high-pressure pump of the present invention is particularly suitable for dispersing to a high degree a solid-liquid mixed phase fluid having a solid dispersed in a liquid to obtain an emulsion. Applicant has found that the reason why the service life of the conventional high-pressure pumps is short is that when the high-pressure cylinder is installed horizontally or it is installed vertically in the upper part of the pump, solid particles in the solid-liquid mixed phase fluid precipitate in the high-pressure cylinder, causing damage to various members, including the gasket in the high-pressure cylinder. The idea of the present invention is based on this finding.

In addition, since the high-pressure pump of the present invention has an opening in the bottommost portion of the high-pressure cylinder to allow the solid-liquid mixed phase fluid to flow in or out of the high-pressure cylinder, there is no possibility that a part of the solid particles in the solid-liquid mixed phase fluid will settle and reside in the high-pressure cylinder.. Therefore, the high-pressure fluid obtained has no concentration distribution. In addition, the migration preventing device is provided In contact with the plunger driving shaft to prevent migration of working fluid leaking out from the hydraulic cylinder to the plunger. Accordingly, there is no likelihood that the solid-liquid mixed phase fluid sucked into the high-pressure cylinder will reside in the high-pressure cylinder.

BRIEF DESCRIPTION OF THE DRAWINGS

FIGS. 2(*a*) and 2(*b*) illustrate conventional high-pressure pumps.

DESCRIPTION OF THE PREFERRED EMBODIMENT

Figure 1:
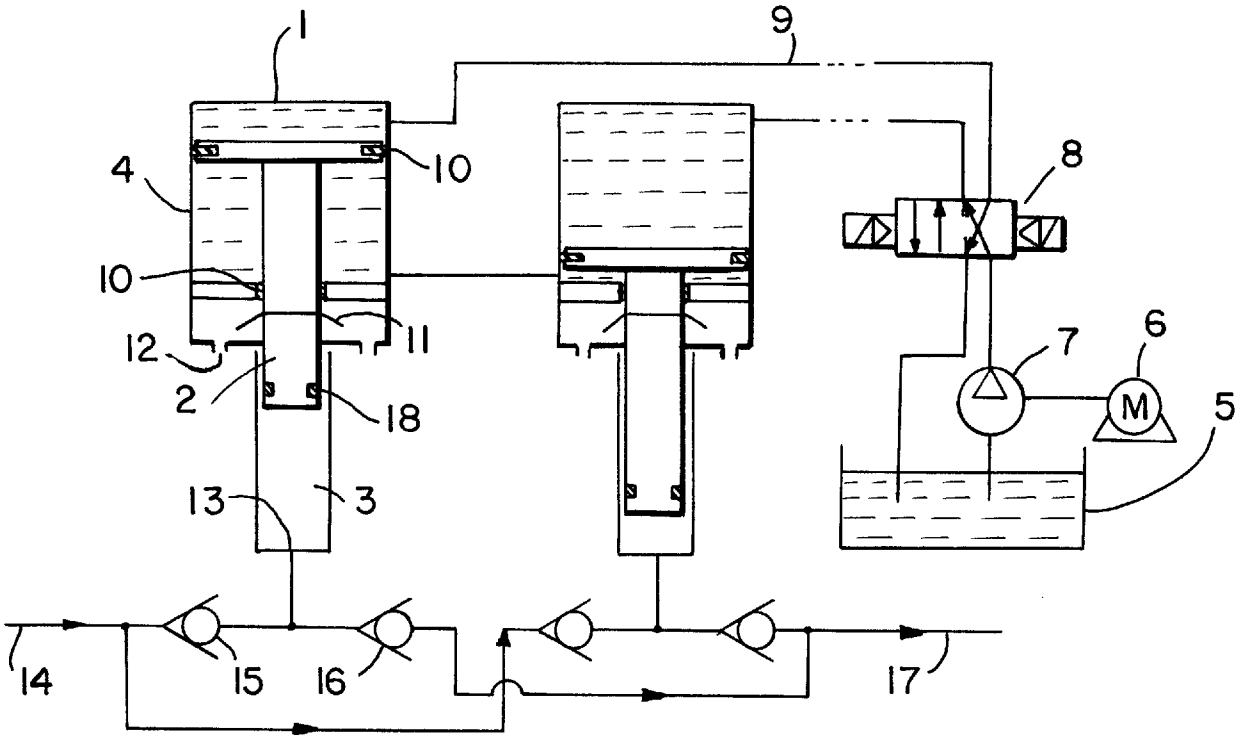
FIG. 1 illustrates the high-pressure pump according to the present invention.

The high-pressure pump of the present invention is shown in FIG. 1. A high-pressure pump 1 has at the bottom thereof a high-pressure cylinder 3 which has a plunger 2 fitted therein from the upper side thereof. A hydraulic cylinder 4 is provided at the top of the high-pressure pump 1. By supplying a working fluid 5 to the hydraulic cylinder 4, the plunger 2 is driven to reciprocate vertically. The working fluid 5 is pressurized by a pressurizing mechanism comprised of a hydraulic pump 7 that is driven by a motor 6, and the pressurized working fluid 5 is alternately supplied to the left and right hydraulic cylinders through a four-way switching valve 8, thereby alternately reciprocating the plungers in the left and right hydraulic cylinders. The working fluid pressurizing mechanism and the high-pressure pump need not be installed in the same place but may be installed in respective places which are away from each other by connecting them by a pipeline 9.

Thus, it is possible to take such measures that the high-pressure pump is installed in a place where a clean room or explosion-proof equipment is provided, while the working fluid pressurizing mechanism is installed outside the above-mentioned place. Therefore, it is possible to provide the high-pressure pump in any place without restriction on the installation environment. Consequently, it becomes possible to use the high-pressure pump as a high-pressure generator for emulsification dispersion, for example, in any place to carry out a process of manufacturing a paint, pigment, ink, pharmaceutical, organic or other photosensitive material, magnetic recording medium, etc. The high-pressure pump can also be used as a long-lasting device for transporting a solid-liquid mixed phase fluid in a process other than those which require high pressure In the high-pressure pump of the present invention, a low-pressure gasket 10 is provided on the low-pressure side plunger, and another low-pressure gasket 10 is provided in the area between the plunger driving shaft and the cylinder sliding surface to prevent leakage at the low-pressure side and leakage of working fluid in the same way as in the case of an ordinary hydraulic cylinder that uses a working fluid. In the present invention, further, a migration preventing device 11 is provided in contact with the plunger driving shaft to prevent entrance of working fluid into the high-pressure cylinder 3 even if the working fluid leaks out through the gasket 10 during operation. The migration preventing device 11 may be formed from a wiper ring, for example, made of a rubber material or the like. Working fluid leaking out through the gasket 10 is removed from the plunger driving shaft by the wiper ring so as to drop in a portion which is away from the driving shaft, and then taken out to the outside from discharge openings 12.

The bottommost portion of the high-pressure cylinder 3 is provided with an opening 13. Thus, a solid-liquid mixed phase fluid which is supplied from an inlet pipe 14 through a check valve 15 is sucked into the high-pressure cylinder 3 through the opening 13. The solid-liquid mixed phase fluid is pressurized to a high pressure and discharged from the opening 13 and then sent to an outlet pipe 17 through a check valve 16. When the left-hand high-pressure pump is in the pressurizing and discharge process, the right-hand high-pressure pump is in the suction process. Accordingly, the left and right high-pressure pumps alternately and continuously repeat suction and discharge, and thus the solid-liquid mixed phase fluid pressurized to a high pressure is almost continuously supplied to the outlet pipe 17.

In addition, since the left and right high-pressure pumps are operated by a working fluid, when one high-pressure pump needs to replace parts, e.g., the high-pressure side gasket 18, it is possible to stop the supply of working fluid to this pump and to allow the other high-pressure pump to continue operating simply by switching over the pipelines 9. Accordingly, during the maintenance of the high-pressure pump system, the pump operation can be continued practically without a stop.

EXAMPLE 1

In a high-pressure pump having a plunger of tungsten carbide inside a high-pressure cylinder made of stainless steel and having an inner diameter of 64 mm, aggregate (center particle diameter: 100 $\mu$m) of titanium oxide having a hardness (Hv) of 800 to 900 and a particle diameter of 2 $\mu$m to 3 $\mu$m was dispersed in 1,1,2-trichloroethane so that the powder weight was 50%. The resulting suspension was pressurized under the condition of 1,400 kgf/cm$^2$ at 25° C. In this state, the high-pressure pump was continuously operated. As a result, a homogeneous solid-liquid mixed phase fluid was obtained. The high-pressure pump was durable for 500 hours. Parts that required replacement after the operation was stopped were only the plunger seal and the check valve plate seals.

Thus, the high-pressure pump of the present invention has a high-pressure cylinder which has a vertically moving plunger fitted therein from the upper side thereof. The high-pressure cylinder has at least one opening provided in the bottommost portion thereof to allow a fluid to flow in or out of the high-pressure cylinder. The high-pressure pump further has a hydraulic cylinder for driving the plunger, which is provided on the top of the high-pressure cylinder. In addition, a migration preventing device is provided between the hydraulic cylinder and the high-pressure cylinder and in contact with the plunger driving shaft to prevent any working fluid leaking out from the hydraulic cylinder from migrating to the plunger. Accordingly, there is no possibility that working fluid leaking out from the upper hydraulic cylinder will migrate to the high-pressure plunger side. Further, since there is no likelihood that the solid-liquid mixed phase fluid flowing into the high-pressure cylinder will reside therein, the plunger gasket and other members can be kept operative for a long period of time without being damaged. Thus, it is possible to obtain a high-pressure pump of long service life.

What we claim is:

1. A high-pressure pump for pressurizing a solid-liquid mixed phase fluid, said high-pressure pump comprising:

a high-pressure cylinder having a vertically moving plunger fitted therein from an upper side thereof, said high-pressure cylinder further having at least one opening connected to inlet and outlet valves in a bottommost portion thereof to allow a fluid to flow in or out of said high-pressure cylinder;

a hydraulic cylinder for driving said plunger, said hydraulic cylinder being provided above said high-pressure cylinder; and migration preventing means comprising a wiper ring which has downward sloping edges provided between said hydraulic cylinder and said high-pressure cylinder and in contact with a plunger driving shaft to prevent migration of a working fluid leaking out from said hydraulic cylinder to a surface of said plunger fitted in said high-pressure cylinder.

2. A high-pressure pump according to claim 1, having a plurality of said hydraulic cylinders and high-pressure cylinders, wherein the working fluid is supplied to said hydraulic cylinders through a switching valve to produce a high-pressure fluid from said high-pressure cylinders alternately.

* * * * *